US006158703A

United States Patent [19]

Kessler et al.

[11] Patent Number: 6,158,703

[45] Date of Patent: Dec. 12, 2000

[54] KICK PLATE AND CONNECTOR FOR SHELVING

[76] Inventors: Ronald N. Kessler, 5324 Logan Arms Dr., Girard, Ohio 44420; Myron E. Ullman, 120 Sleepy Hollow Dr., Canfield, Ohio 44406

[21] Appl. No.: 09/301,411

[22] Filed: Apr. 28, 1999

Related U.S. Application Data

[60] Provisional application No. 60/108,909, Nov. 18, 1998, and provisional application No. 60/111,171, Dec. 7, 1998.

[51] Int. Cl.[7] ..... A47G 29/00

[52] U.S. Cl. ..... 248/240; 248/235; 312/327

[58] Field of Search ..... 312/278, 279, 312/327, 234.4, 234.5; 211/189, 186, 87.01, 90.01; 248/235, 240, 245; 52/69; 49/462, 470; 16/402

[56] References Cited

U.S. PATENT DOCUMENTS

| | | | |
|---|---|---|---|
| 2,330,276 | 9/1943 | Foster | 312/327 |
| 2,919,340 | 12/1959 | Jacobs | 219/209 |
| 5,465,532 | 11/1995 | Varin | 49/470 |
| 5,613,747 | 3/1997 | Becker et al. | 312/278 |
| 5,755,498 | 5/1998 | Cutler | 312/278 |

*Primary Examiner*—Ramon O Ramirez
*Assistant Examiner*—Jon A Szumny
*Attorney, Agent, or Firm*—Robert G. Lev

[57] ABSTRACT

A new kick plate arrangement for conventional metal shelving is provided by a support clip which fits into a conventional kick plate holder. The support clip supports the kick plate by means of a horizontal extension. The kick plate can be rotated up and under the horizontal support structure upon which the shelving is mounted. A second embodiment includes a plastic connecting device which fits onto a conventional horizontal shelf support. The plastic connecting device supports the plastic kick plate using a cylindrical horizontal support along the horizontal shoulder of the kick plate. The kick plate can be rotated up and under the conventional horizontal support structure upon which the shelving is mounted. The cylindrical horizontal support structure is attached to the kick plate by use of slots in the front face of the kick plate through which the cylindrical horizontal support passes before being rotated to fit against the horizontal shoulder of the kick plate, and is supported by a clamping device which connects to the conventional horizontal support structure upon which the shelving is mounted.

24 Claims, 4 Drawing Sheets

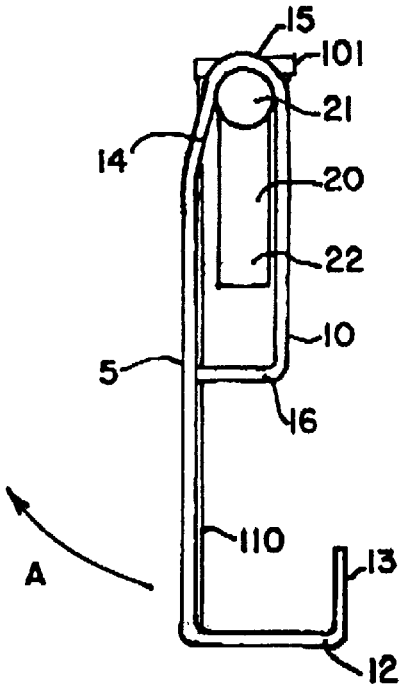
FIG. 1
FIG. 2
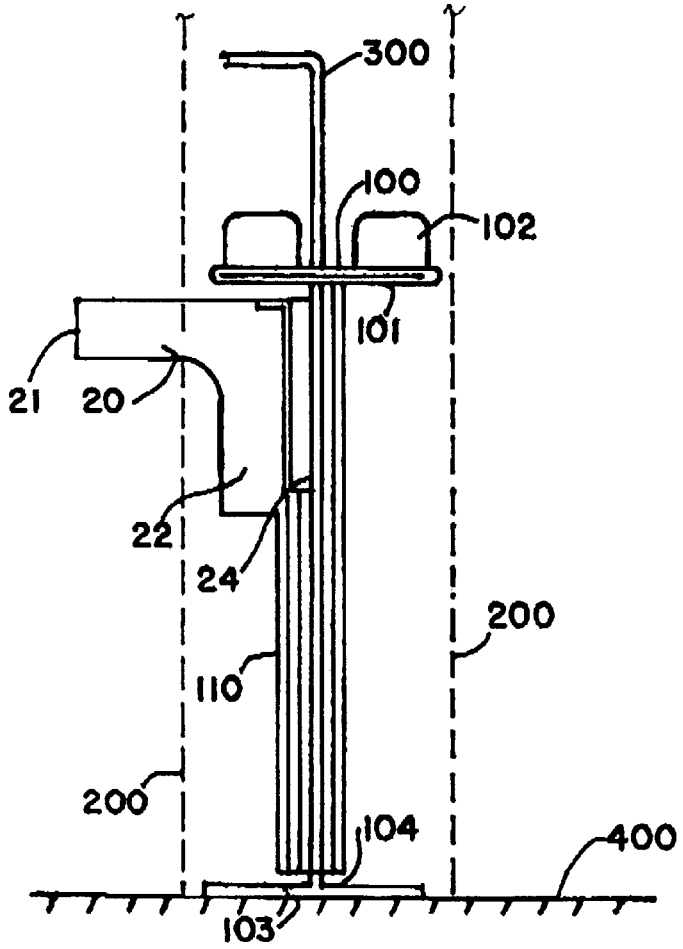

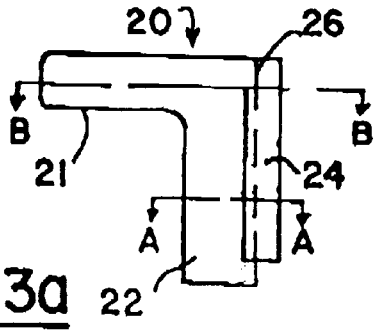
FIG. 3a
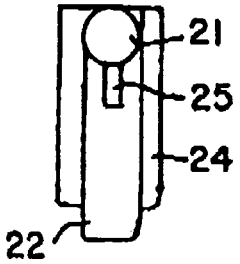
FIG. 3b
FIG. 3c
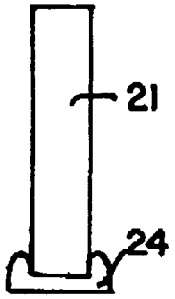
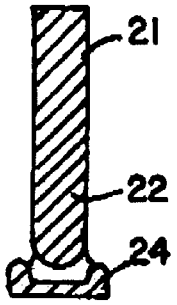
FIG. 3e
FIG. 3d
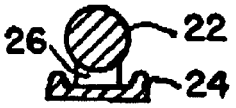
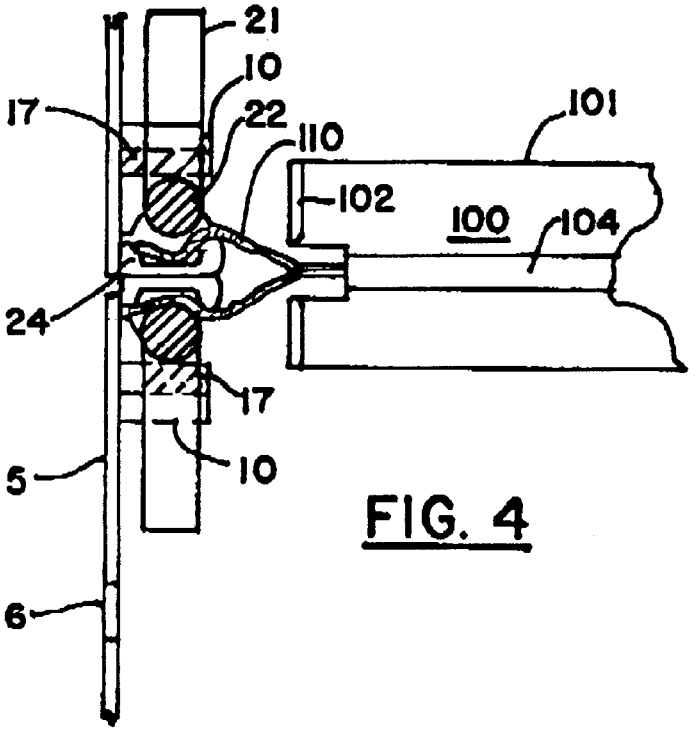
FIG. 4

FIG. 7
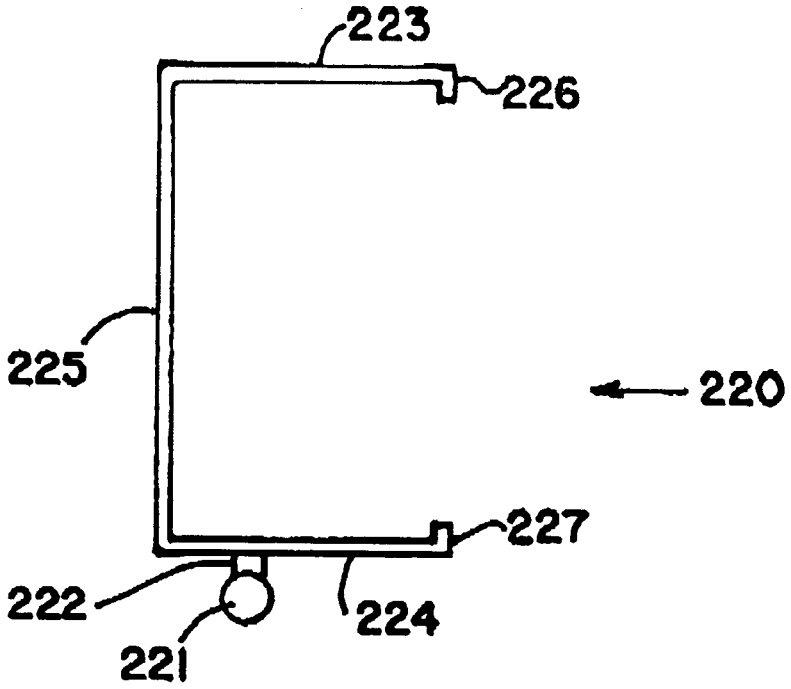
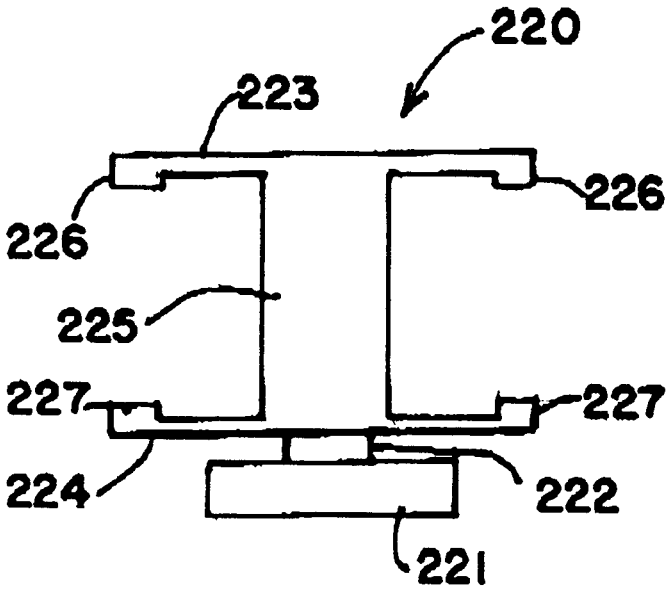
FIG. 8

KICK PLATE AND CONNECTOR FOR SHELVING

This application claims the priority benefit of provisional applications 60/108,909 filed Nov. 18, 1998 and 60/111,171 filed Dec. 7, 1998.

TECHNICAL FIELD

The present invention relates generally to the field of shelving and the kick plates that are provided at the bottom of shelving arrangements. In particular, the present invention is directed to an easily-removable kick plate and a support system for connecting it to conventional shelving.

BACKGROUND ART

A standard type of heavy-duty, metal, industrial shelving is constituted by vertical supports (200 in FIG. 2) which hold the horizontal supports (110 in FIG. 2) that are used to support the vertical shelving. The upper vertical supports are usually secured to a wall or other stable, supporting structure, and can also be supported by a floor (400 in FIG. 2) or other horizontal structure. The horizontal supports are secured to the vertical supports using any number of techniques well-known in this technology. Preferably, the horizontal supports are entirely supported by the connection to the vertical supports. However, the horizontal supports carrying the lowest tier of shelves can also rest upon the floor (400 in FIG. 2) beneath the shelf system. The conventional art includes systems in which the lowest horizontal supports are entirely separate from the underlying floor, as well as those in which the lowest horizontal support is supported by the floor as well as the vertical supports.

It is usual to place a kick plate between the lowest tier of shelves and the floor. This prevents objects from rolling under the shelving, and is particulary useful in keeping the feet of pedestrians and debris from slipping under the shelving causing damage to the shelving, the goods thereon and the pedestrians. Thus, the use of kick plates on the lowest tier of shelving arrangement are essential, especially in areas having high traffic.

In conventional shelving systems the kick plates are rigidly mounted, usually to the lowest shelf and/or the lowest tier of horizontal supports. This arrangement is adequate for keeping the feet of passing pedestrians from becoming entangled underneath the lowest tier of shelving. However, because the kick plates are rigidly mounted, usually with screws, removal of the kick plates can be an awkward and time-consuming process. To facilitate easy removal of kick plates, metal kick plate holders, such as 110 (depicted by the shaded structure in FIG. 4), have been used in conventional shelving systems to hold kick plates, extending to either side of the clip. The metal kick plate holder 110 is formed of opposing S-shaped arms, or other equivalents thereto, and is used to hold the kick plates in a rigid position while permitting removal of the kick plates without recourse to the tools necessary to manipulate bolts and/or screws.

Nonetheless, removal and replacement of the kick plates using the conventional metal kick plate holders are still awkward and time consuming processes. In particular, an individual removing or replacing the kick plates has to move the shelf 300 immediately above the kick plate in order to slide the kick plate up and out of the conventional kick plate holder 110 (in FIGS. 2 and 4). This means that all of the items stored on the shelf must also be removed. Consequently removal and replacement of the kick plate can be a very awkward, time-consuming and irritating process.

Normally, this would not be a problem since in may cases there is often little reason to remove and replace the kick plates on a regular basis. However, the shelves are often made to include perforations therein. Also, there are often gaps between adjacent shelves, as well as gaps between the shelves and the vertical supports, as well as the shelves and the wall upon which the vertical supports may be mounted. As a result, over a period of time, dirt and dust will settle through the perforations and gaps in the shelving system so that the space under the lowest tier of shelves (and behind the kick plates) must be cleaned. Under normal conditions, this situation would not occur very frequently so that the removal and replacement of kick plates would not be an urgent matter.

However, when particulate matter, such as detergent, bird seed, small metal or plastic scrap, grit, coffee, sugar, etc. are being stored on the shelving system, large amounts of debris will accumulate very quickly so that the space around the shelving system must be constantly cleaned. This is particularly urgent when various types of liquid or semi-liquid products are stored on the shelves and are subject to normal spillage occurring when the products are placed on the shelves, removed therefrom or otherwise manipulated. When dealing with liquid or semi-liquid spillage, immediate access to the area beneath the shelves is a necessity since spillage is liable to spread beyond the area of the shelving and constitute a hazard. A situation requiring rapid cleaning beneath the shelving also occurs when the spillage is organic in nature, having a tendency to undergo rapid decay, thereby creating health problems.

The aforementioned spillage situations are best addressed by a kick plate arrangement that can be quickly and easily removed to allow full access to the area beneath the shelving. However, conventional kick plate connection arrangements do not permit a quick, easy removal that facilitates rapid cleaning of the area underneath the shelves.

SUMMARY OF THE INVENTION

Accordingly it is an object of the present invention to provide an easily removable kick plate for a shelving system.

It is another object of the present invention to provide a removable kick plate that can be easily and temporarily stored within the shelving system, without resort to the use of shelf space.

It is a further object of the present invention to provide a kick plate for a shelving system wherein the kick plate can be quickly and easily replaced into it's normal functional position.

It is yet another object of the present invention to provide a shelving system kick plate of a light flexible, rust-resistant material that can be used with a variety of different shelving materials.

It is again a further object of the present invention to provide a kick plate for a shelving system arranged so that the kick plate can be easily manipulated without removing the shelf above the kick plate.

It is still a further object of the present invention to provide a kick plate for a shelving system that permits full access beneath the shelving for purposes of cleaning.

These and other objects and purposes of the present invention are accomplished by a kick plate and support arrangement for attaching the kick plate to an existing shelving system which has a horizontal support structure beneath the lower shelf and across the shelf length. The support includes two vertical clamps for attaching to the horizontal support structure of the existing shelf system. A connecting bridge is attached to each clamp and extends vertically beneath the horizontal support structure. The horizontal support device for rotatably supporting the kick plate is attached to each of the connecting bridges beneath the horizontal support structure and extend parallel to the horizontal support structure. The kick plate has a front piece, a back piece and a shoulder piece which connects to the front piece and the back piece. There is at a least two slots in the front piece and shoulder of the kick plate to accommodate passage of the horizontal support device.

In another embodiment the kick plate and support arrangement are used for attaching the kick plate at it's two ends to an existing shelving system having two conventional horizontal support structures extending transversely beneath the lower shelf. The support arrangement includes two vertical clamps for attaching to the corresponding conventional horizontal support structures of the existing shelving system. Each vertical clamp supports the horizontal support device for rotatably supporting the kick plate at each end of the kick plate by extending transversely to the horizontal support structure. The kick plate has a front piece, a back piece and a shoulder piece connecting the front piece and back piece. A space under the shoulder piece is configured to accommodate the horizontal support device.

BRIEF DESCRIPTION OF THE DRAWINGS

FIG. 1 is a side view diagram, depicting the hanger of the present invention.

FIG. 2 is a front view drawing depicting the support clip of the present invention mounted on conventional shelving.

FIG. 3(*a*) is a detailed side view depicting the support clip of the present invention.

FIG. 3(*b*) is a front view depicting the support clip of the present invention.

FIG. 3(*c*) is a top view depicting the support clip of the present invention.

FIG. 3(*d*) is a sectional view depicting the support clip of the present invention.

FIG. 3(*e*) is another sectional view depicting the support clip of the present invention;

FIG. 4 is a top view diagram depicting the mounting of adjacent kick plates.

FIG. 7 is a detailed side view diagram depicting the connecting of the present invention.

FIG. 8 is a front view diagram depicting the connecting device of the present invention.

DETAILED DESCRIPTION OF THE PREFERRED EMBODIMENTS

Figure 5:
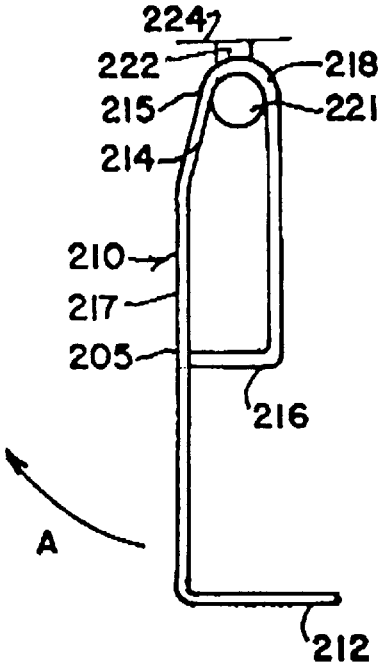
FIG. 5 is a side view diagram, depicting details of the cylindrical horizontal support and kick plate of the present invention.

The environment in which the present invention operates is partially depicted in FIG. 2. A shelf 300 is supported by a horizontal support 100 which in turn is supported by floor 400 and vertical support 200 (enclosed by dashed lines). The vertical support structure 200 can be any number of different designs well-known in this technology, and can be used to support the horizontal support piece 100 in a variety of different ways well known to practitioners in this technology. The horizontal support 100 is used to support the shelf 300 lowest to the ground 400, and is the only portion of the shelving system that is relevant to the present invention since only the lowest shelves are associated with a kick plate (5 in FIG. 4). The exact detail of the vertical support 200 and the shelf 300 are not relevant to the present invention, and so are not discussed in further details for purposes of this application.

The horizontal support structure 100 has details that are relevant to the present invention by virtue of the fact that the present invention includes adaptations that interface with conventional kick plate holder 110. The horizontal support structure 100, as depicted in FIG. 2 is a generally "I" shaped structure with an upright center portion 104 and two perpendicular cross pieces 101, 103, forming the top and bottom portions, respectively, of the "I" structure. The bottom cross piece 103 is used to help support the horizontal support 100 on floor 400. However, for purposes of the present invention, the floor support 103 is not necessary since the horizontal support piece 100 can be entirely supported by the vertical support structure 200. The upper cross piece 101 contains two tabs 102.

Tabs 102 are generally created in order to hold adjacent shelves 300 together at upright center portion 104 of the horizontal support 100. The tabs 102 afford easy alignment when placing shelves 300 on the horizontal supports 100. The tabs 102 can also be used to help handle the horizontal support structure 100 when it is fitted to the vertical support structure 200. However, such tabs are not necessary to the present invention.

The upper cross piece 101 is used to support ends of adjacent shelves 300 (only one shown). These shelves can be attached to the support system in a variety of different ways already well-known in the conventional shelving art, and require no further elaboration for purposes of this invention. Of course, only one end of a single shelf will be supported by a horizontal support piece 100 at an end of the shelving system.

The conventional metal kick plate holder 110 (best depicted in FIG. 4) is used to hold adjacent kick plates (not depicted) for conventional shelving arrangements. The kick plate holder 110 is arranged to hold perpendicular flanges (not shown) of two adjacent kick plates of conventional design. The present invention uses a vertical support clip 20, as depicted in FIGS. 3(*a*)–3(*e*) to support kick plate 10 of the present invention. The vertical support clip 20 is mounted on a conventional metal kick plate holder 110 as depicted in the top view of FIG. 4 and the front view of FIG. 2. By using vertical support clip 20, no additional modifications or additions are needed to the conventional kick plate holder 110.

The fit of vertical support clip 20 on a conventional kick plate holder 110 is facilitated by the configuration of the support clip. In particular, the vertical cylindrical shaft 22 conforms easily to the configuration of the conventional kick plate holder 110. A rear holding piece 24 is used to hold the rest of vertical support clip 20 to the conventional kick plate holder 110, and is configured to fit around the conventional kick plate holder 110. The rear holding piece 24 is connected to the rest of the support clip 20 by means of a connecting piece 26. The horizontal cylinder 21 is used to hold a kick plate 10 (more fully depicted in FIG. 1). The kick plate 10 has a front surface 5. Preferably, the vertical support clip 20, and kick plate 10 are all made of plastic. However, other flexible or malleable materials can be used. Further, all of the aforementioned conventional elements can be made out of various types of metal, including that which constitutes the conventional shelving.

It should be noted that in one alternative form, vertical support clip 20 can be formed of a plurality of different parts made of brass or any other suitable metal. Cylinders 21 and 22 are cut so that they can be welded to each other, being partially supported by weld piece 25. Likewise, the holding piece 24 can be welded using a connecting piece 26, to vertical cylinder 22. The connecting piece 26 is so arranged so that the conventional kick plate holder 110 extends between connecting piece 26 and cylinder 22 approximately ½ the diameter of horizontal cylinder 21 when support clip 20 is mounted on kick plate holder 110. Because of this arrangement, the vertical support clip 20 can be mounted on the conventional kick plate holder 110 in a position that allows the kick plate 10 to be slid over vertical support clip 20 and beneath cross piece 101.

It should be noted that vertical support clip 20, while preferably constituted of plastic, it can be made of any suitable material (such as material), and the vertical and horizontal cylinders 21, 22 can have other configurations. For example, the vertical cylinder 22 can have any shape configured to fit easily with any conventional kick plate holder 110. Thus, the shape of this element can be square, triangular, hexagonal, etc. Likewise, the shape of the horizontal cylinder 21 can also be configured to have cross sections that are hexagonal, triangular, ellipsoid, etc. However, it has been discovered that the horizontal cylinder 21 functions best when it is configured to have a circular cross section.

The circular configuration of the horizontal cylinder 21 permits easy interface with the kick plate 10, which has a circular holding piece 15 which interfaces with cylinder 21 when the kick plate 10 is in it's normal position. Shank 14 forms a connecting piece between the vertical kick plate face 5 and the circular holding piece 15. The angle formed by this connecting piece helps permit easy movement of it along cylinder 21 when the kick plate 10 is swung outward in the direction A as indicated by the arrow in FIG. 1.

It should be noted that the kick plates 10 can be swung only in the direction A rather than in the opposite direction. This is true because conventional kick plate holder 110 prevents such movement by virtue of interfering with the spur 13 or even bottom piece 12 (if spur 13 was missing). The kick plate 10 is further held onto cylinder 21 by virtue of back piece 16 which can form as an enclosed loop. This structure helps to ensure that the kick plate 10 stays on the vertical support clip 20, no matter what type of manipulation the kick plate 10 is subjected to.

As indicated in FIG. 4, kick plates 10 extend only to the center of conventional horizontal shelf support 100. Thus, each conventional horizontal shelf support 100 can accommodate a single end of two adjacent kick plates 10. The kick plate 10 which fits flush to floor 400 by virtue of floor piece 12 can easily be maneuvered by virtue of hole 6. Each kick plate can be moved in direction A, as depicted in FIG. 1 so that the kick plate 10 rotates about horizontal cylinder 21 and then slides along shank 14 to allow the vertical front surface 5 of the kick plate 10 to slide easily under upper cross piece 101.

This is facilitated by a notch 17 cut into each of the kick plates 10 so that as the kick plate 5 moves under cross piece 101, there is clearance between circular holding piece 15 of kick plate 10 and conventional kick plate holder 110. As a result, there will not be interference as the kick plate 10 is slid over the top of vertical support clip 20 and under cross piece 101 to be held there for the purpose of cleaning beneath shelf 300.

When cleaning is done, it is easy to slide the kick plate 10 back into it's original position. There is little likelihood of the kick plate 10 slipping off of the horizontal shaft 21 due to a relatively close fit of the circular holding piece 15 and the closed nature of the back piece 16 of the kick plate holder 10. A substantial gap between back piece 16 and the kick plate front surface 5 permits ample space for the kick plate 10 to be maneuvered. Movement of the kick plate in a direction opposite that depicted by arrow A in FIG. 1 is impossible because of the conventional horizontal shelf support 100.

Front surface 5 and shank 14 of the kick plate extend for the entire length of the kick plate. However, circular holding piece 15, as well as back piece 16 need not extend for the entire length of the kick piece. Rather, these structures can be as shown in FIG. 4, extending only as far as needed to provide an interface at either end of the kick plate 10 with vertical support clip 20 to hold the kick plate in position. However, manufacturing a kick plate in which the circular holding piece 15 as well as the back portion 16 extend the entire length of the kick plate may be easier than the aforementioned alternative. Consequently, the full extension of the circular holding piece 15 and the back piece 16 across the entire length of the kick plate 10 is preferred. Since the kick plate is usually attached to metal shelving, it can be made of metal to conform to the shelving. In the alternative, because of the relatively low cost of plastic, the metal kick plate is preferably made of plastic. For the same reasons, vertical support clip 20 is also preferably made of plastic due to the lower costs of production.

Figure 6:
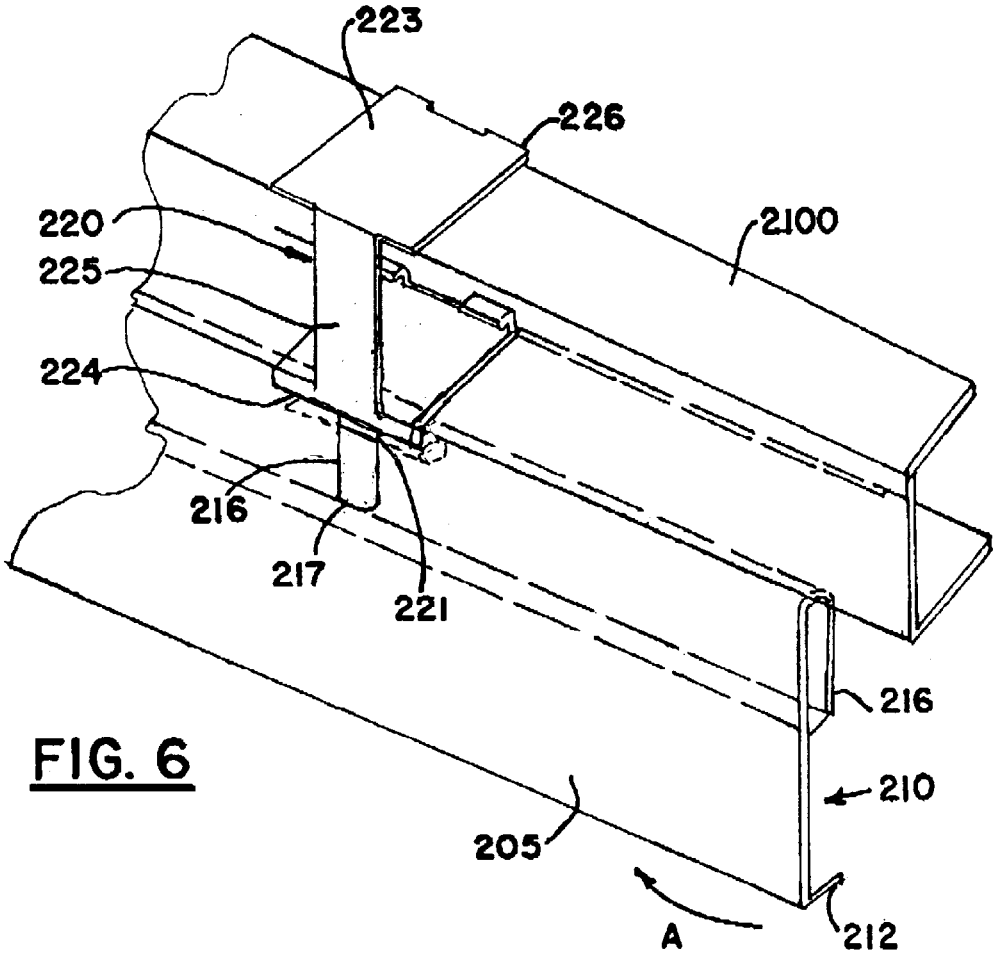
FIG. 6 is a perspective view diagram depicting the present invention mounted on conventional shelving.

The environment in which a second embodiment of the present invention operates is partially depicted in FIG. 6. A shelf (not shown) is supported by a conventional horizontal support structure 2100 (preferably a U-beam) which in turn is supported by a vertical support structure (not shown). This vertical support structure (not shown) can be any number of different designs well-known in this technology, and can be used to support the horizontal support structure 2100 in a variety of different ways well known to practitioners in this technology.

The conventional horizontal support structure 2100 is used to support the shelf lowest to the ground (not shown), and is the only portion of the conventional shelving system that is relevant to the present invention since only the lowest shelves are associated with a kick plate (210 in FIGS. 5 and 6). The exact detail of the vertical supports and the shelves are not relevant to this embodiment of the present invention, and so are not discussed in further detail for purposes of this application.

The conventional horizontal support structure 2100 has details that are relevant to the present invention by virtue of the fact that the present invention includes adaptations that interface with it. The conventional horizontal support structure 2100, as depicted in FIG. 6 is a generally a U-shaped structure. Preferably, the connecting device 220, and kick plate 210 are all made of plastic. Molded plastic is particularly appropriate for this device due to the low cost of manufacturing. Further, the shape of the connecting device 20 is particularly appropriate for manufacturing using molded plastic processes. However, other flexible or spring-like materials can be used. For example, all of the aforementioned elements (220, 210) can be made out of various types of metal, including that which constitutes the conventional shelving. In one alternative form, connecting device 220 can be formed of a plurality of different parts made of brass, and welded or soldered together.

The conventional horizontal support structure 2100 is preferably a U-shape as depicted in FIG. 6. However, the present invention can be configured to attach to other shapes of either the horizontal support structure 2100, or the shelving itself (if the conventional horizontal support structure is not present).

The preferred variation of the second embodiment of the present invention includes a clamping arrangement as part of connecting device 220 configured to attach to the horizontal support 2100. The connecting device 220 is configured to conform to the U-shape of the conventional horizontal support structure 2100. However, the concept of the second embodiment of the present invention permits different shapes for the clamp device 220 in order to conform to different shapes of the horizontal support structure 2100, or the shelving (not shown).

In the preferred variation of this embodiment, the clamping device 220 has an upper arm 223, a lower arm 224 and a connecting arm 225 configured to connect the other two arms 223, 224 into a unitary structure. The connecting arm 225 need not be as wide as the other two arms 223, 224. The particular configuration depicted in FIG. 8 is facilitated by the injection molding process used to make the connecting device 220. Other manufacturing techniques may facilitate altered configurations of the connecting device 220 while maintaining inventive concepts of the second embodiment of the present invention.

The distal ends (opposite connecting arm 225) of upper and lower arms 223, 224 have handling structures 226, 227 that are configured to grasp the edges of the U-shaped horizontal support 2100. The holding structures 226 are essentially flanges extending perpendicular to upper arms 223. In contrast, holding structures 227 are claw-like structures configured to curl around the edge of the U-shaped conventional horizontal support structure 2100, thereby holding the connecting device 220 firmly to the conventional horizontal support structure 2100. Because the material of the connecting device 220 is sufficiently flexible, the holding structures 226 can be fitted over the edges of horizontal support structure 100 without undue stress, once the horizontal support 221 has been manipulated through slot 6 in kick plate 210.

In the first variation of the second preferred embodiment, the connecting device 20 is made of plastic, as is the horizontal support 221, which is part of the connecting device 220. However, the connecting device 220 and the kick plate 210 can be made of any suitable material, including nylon or rubber. Further, the connecting device 220 and the horizontal support 221 can be made out of a metal material so long as the metal has sufficient flexibility to allow the hook-like structures 226 to easily be fit over the edges of the horizontal support structure 100. For example, the entire structure of the clamping device 220 including the horizontal support 221 can be made of a variety of matters, such as brass. However, this is substantially more expensive than plastic since horizontal support 21 is connected to the lower arm 224 by means of a cylindrical connecting bridge 222. If the connecting device 220 is made of metal, this may entail a welding or a soldering operation. Preferably both the connecting bridge 222 and horizontal support 221 are both cylindrical in cross section to facilitate easy manipulation of both these parts into slot 206 of kick plate 210. Anything but a smooth circular shape on the cylindrical connecting bridge 222 would make the maneuvering of the horizontal support 221 and the connecting bridge 222 through slot 206 extremely awkward.

The whole connecting device 220 (including cylindrical support 221) can be formed from a single plastic mold. Even if the connecting device 220 and the horizontal support 21 are formed from separate plastic molds, it is relatively easy to connect the two together by means of solvent bonding, gluing or any other technique used in the manufacture of plastic products.

FIG. 7 depicts a side view of the connecting device 20 which supports cylindrical horizontal support 221 by way of connecting bridge 222. The horizontal support 221 is arranged to be closer to the connecting arm 225 so that the kick plate 210 is arranged as closely to the front of horizontal support 2100 (and thus the rest of the shelving arrangement) as possible. However, the position of horizontal support 221 can be adjusted in accordance with the overall configuration of the conventional shelving to which the present invention will be attached, or to any configuration of shelving and kick plates desired by the owners or arrangers of the shelving system.

The horizontal support 221 is depicted in all drawings as being cylindrical in shape. Accordingly, shoulder 215 of kick plate 210 is rounded to conform with the cylindrical shape of horizontal support 221. In this variation of the second preferred embodiment, kick plate 210 swings easily on horizontal support 221 as a result of the conformity of the shape of shoulder 215 to the cylindrical horizontal support 221. However, other shapes of both the horizontal support 221 and the shoulder 215 can be used while maintaining the concept of the present invention. For example, the shape of the horizontal support 221 could be triangular or hexagonal. Preferably, the shape of the shoulder 215 would be altered to conform to the shape of the horizontal support 221 to better enhance the operation of kick plate 210. Despite the shape of horizontal support 221, the connecting bridge 222 will always have a circular cross section and a smooth cylindrical surface. While other shapes are possible, they would detract from the effectiveness of this embodiment of the present invention.

FIGS. 6–8 depict four holding structures 226, 227 arranged at the distal ends and near the outer edges of upper and lower arms 223, 224. However, other configurations of holding structure 226 can be used while maintaining the concept of the present invention. The specific holding structures depicted in the drawings are not necessary to hold the connecting device 220 onto the conventional horizontal support structure 2100. Rather, any technique that would occur to one skilled in this art can be used, including adhesives, solvent bonding, or the weight of a shelf resting upon conventional horizontal support structure 2100.

FIG. 8 depicts a rear view of the connection device 220. The smaller width of the connecting arm 225 is arranged so that the overall connecting device 220 flexes sufficiently to allow the upper and lower arms 223, 224 to extend sufficiently over the conventional horizontal support structure 2100 so that the hook-like structures 226 are able to grasp the edges of the U-shaped conventional horizontal support structure 2100, thereby holding the connecting device 220 to the horizontal support structure 2100 and providing a mounting for cylindrical horizontal support 221.

The cylindrical horizontal support 221 is attached to lower arm 224 by way of cylindrical connecting bridge 222. This connecting bridge need be sized, configured as necessary to provide a connection between lower arm 224 and cylindrical horizontal support 221. The size and strength of the cylindrical connecting bridge 222 will depend upon the size and weight of the kick plate 210 to be supported by the cylindrical horizontal support 221. The respective cross sections of the cylindrical connecting bridge 222 and the cylindrical horizontal support 221 determine the size of the slot 206.

Preferably for each section of the shelving, having a single discrete kick plate, two connecting devices 220 are used to hold the kick plate 210. The connecting devices 220 are located relatively proximate to each end of the kick plate 210. The length of the cylindrical horizontal support 221 can be adjusted to any value appropriate to providing adequate support for a particular kick plate 210. While cylindrical horizontal support 221 is depicted to have a length less than that of the width of the lower arm 224, this is not a requirement of the present invention. However, the length of the cylindrical horizontal support 221 must be appropriate so that it can be easily maneuvered through slot 206 in the front face 205 of kick plate 210.

Preferably slot 206 is of sufficient width to permit easy passage of cylindrical horizontal support 221 and the length approximately one-third of the height of the kick plate 210 so that the entire length of cylindrical horizontal support 221 can be easily accommodated. Preferably the length of slot 206 is slightly larger than the length of the cylindrical horizontal support 221 so that cylindrical horizontal support 221 and cylindrical image 222 can be easily fit through the slot, and then rotated to fit against shoulder 215 on either side of the slot 206. When assembling the present invention so that a kick plate 210 can be supported from a conventional horizontal shelving support 2100, the connecting device 220 is turned so that cylindrical horizontal support 221 can be fit through the slot 206 lengthwise. Once this is done, clamping device 220 is rotated so that the cylindrical horizontal support 221 extends along the length of the kick plate 210, interfacing with the kick plate along rounded shoulder piece 215 so that the kick plate is supported thereby.

Because the cylindrical support 221 is placed lengthwise through slot 6, the length of cylindrical support 221 is limited to a size of slot 206 that is practical for a particular kick plate 210. A slot that is large enough to accommodate an extremely long cylindrical horizontal support 221 may create a sufficiently large opening in the kick plate 210 that the kick plate is weakened and distortion of the kick plate results. As a result the purpose of the kick plate may be partially defeated. Further, even with a relatively short slot 6 (at least two such slots are for the first preferred embodiment), made in the kick plate the apertures would be sufficiently large to allow substantial distortion of the kickplate, thereby defeating it's purpose.

Ensuring that debris will not pass through slot 206 behind the kick plate 210 one use of back piece 216. Another purpose of back piece 216 is to prevent or reduce distortion of the overall kick plate 210. Such distortion may defeat the purpose of the kick plate by allowing substantial amounts of debris to pass around the kick plate. Further, substantial distortion to the kick plate may also prevent the kick plate from easily lifted from position, and slid beneath the conventional horizontal support 2100 for easy cleaning beneath the shelving.

In the second preferred embodiment, back piece 216 forms a closed structure connecting to the back of front plate 205 of kick plate 210. The connection is preferably beneath the bottom 217 of slot 206 so as to ensure that distortion of the kick plate that might be caused by slot 206 is minimized. The back piece 216 is also crucial to holding the kick plate 210 onto the cylindrical horizontal support 221. The top edge is located on the rounded shoulder 15 of the kick plate 10. The slot edge 18 is located so that cylindrical connecting bridge 22 can extend through shoulder 15.

Normally the kick plate 10 will swing in direction "A" so that the kick plate can slide over cylindrical horizontal support 21 and beneath lower arm 24. In this manner, the kick plate can be moved out of it's normal position and held just below conventional horizontal support structure 100. The extent to which kick plate 10 can be slid under support 100 depends upon the location of the lower edge 17 of slot 6. Preferably, the lower edge 17 is located so that kick plate 10 can be slid far enough under support 100 so that it is held there until deliberately slid back into the normal position of the kick plate. The length of the slot 6 can be adjusted so that it extends as far as ½ the entire height of the kick plate 10. Preferably, back piece 16 will be extended to fully cover the extended length of the slot, thereby adding stiffening to the kick plate 210 and preventing deformation of the kick plate. Rotation of the kick plate in a direction opposite that of "A" is prohibited by upper edge 18 of slot 6 against connecting bridge 222.

The circular configuration of the cylindrical horizontal support 221 permits easy interface with the kick plate 210, which has a circular shoulder piece 215 that interfaces with cylinder 221 when the kick plate 210 is in a normal position to block access to beneath the shelves (not shown). Shank 214 forms a connecting piece between the vertical kick plate face 205 and the circular shoulder piece 215. The angle formed by shank 214 as a connecting piece helps permit easy movement of it along cylindrical horizontal support 221 when the kick plate 210 is swung outward in the direction A as indicated by the arrow in FIG. 1.

The kick plate 210 which fits flush to floor by virtue of floor piece 12 can easily be maneuvered by virtue of slot 206 or a hole as provided in the first embodiment. Each kick plate can be moved in direction A, as depicted in FIG. 5 so that the kick plate 210 rotates about horizontal cylindrical horizontal support 221 and then slides along shank 214 to allow the vertical front surface 205 of the kick plate 210 to slide easily under the conventional horizontal support structure 2100.

When cleaning is done, it is easy to slide the kick plate 210 back into it's original position. There is little likelihood of the kick plate 210 slipping off of the cylindrical horizontal support 21 due to a relatively close fit of the circular shoulder 15 and the closed nature of the back piece 16 of the kick plate 10.

The kick plate 210 of the second preferred embodiment of the present invention is highly flexible, due in part to the plastic material constituting the device. Consequently, a wide variety of different conventional shelving configurations can be accommodated by the kick plate and supports of this embodiment of the present invention. For example, when the conventional shelving system has diagonal supports between the conventional horizontal support and vertical supports, the kick plate has to be cut in order to accommodate the presence of these diagonal supports. Since the connecting devices 220 can be placed anywhere on the conventional horizontal support 2100, this embodiment of the present invention can accommodate the conventional shelving configuration having front-mounted diagonal supports. The kick plate, preferably made of plastic, can be easily cut to any size required by the conventional shelving configuration. Accordingly, this embodiment of the present invention is exceptionally flexible with respect to fitting into conventional arrangements.

While a number of embodiments of the present invention have been provided by way of example, the present invention should not be construed to be limited thereby. Rather, the present invention should be interpreted to encompass any modifications, variations, permutations, and adaptations that would occur to one skilled in this art who has been taught the invention by the present application. For example, the configuration of the vertical support clip 20 can be altered to accommodate any conventional shelving configuration, especially that of a conventional kick plate holder. Therefore, the present invention should be construed to be limited only by the scope of the following claims.

What is claimed is:

1. A kick plate and support arrangement for attaching said kick plate to an existing shelving system having a horizontal support structure beneath a lowest shelf and across its length, said support arrangement comprising:

(a) two vertical clamp means for attaching to said horizontal support structure of said existing shelf system;

(b) a connecting bridge attached to each said clamp means and adapted to extend vertically beneath said horizontal support structure; and, (c) two horizontal support means for rotatably supporting said kick plate, each said horizontal support means being connected to said connecting bridge beneath said horizontal support structure and extending parallel to said horizontal support structure; said kick plate having a front piece, a back piece, and a shoulder piece connecting said front piece, and said back piece, and at least two slots in said front piece and said shoulder to accommodate passage of said horizontal support means.

2. The kick plate and support arrangement of claim 1, wherein said support arrangement is comprised of plastic material.

3. The kick plate and support arrangement of claim 2, wherein said shoulder piece is rounded.

4. The kick plate and support arrangement of claim 3, wherein said rounded shoulder piece has a curvature conforming to a curvature of said cylindrical support means.

5. The kick plate and support arrangement of claim 3, wherein said back piece is configured to extend from said shoulder piece to a back surface of said front piece.

6. The kick plate and support arrangement of claim 5, wherein said back piece, said shoulder piece and said front piece form a closed structure.

7. The kick plate and support arrangement of claim 1, wherein said arrangement is comprised of a metal material having spring-like characteristics.

8. The kick plate and support arrangement of claim 1, wherein said two horizontal support means are cylindrical and said clamp means are comprised of metal and all other parts of said arrangement are comprised of plastic.

9. The kick plate and support arrangement of claim 3, wherein one of said at least two slots in said front piece has a length of a size adapted to accommodate the length of said horizontal support means, said one of said at least two slots further having a width of a size to accommodate passage of a width of said horizontal support means.

10. The kick plate and support arrangement of claim 9, wherein said one of said at least two slots is of a size adapted to permit rotational movement of said kick plate about said horizontal support means, and translational movement of said kick plate over said horizontal support means and beneath said support structure of said existing shelving.

11. The kick plate and support arrangement of claim 10, wherein said clamp means to comprises a U-shape having an upper arm arranged to fit over said horizontal support structure, a lower arm arranged to fit beneath said support structure and a connecting arm arranged to fit on a front surface of said horizontal support structure, said lower arm being connected to said connecting bridge.

12. The kick plate and support arrangement of claim 11, wherein said upper and lower arms have distal ends opposite said connecting arm, said distal end each having a hook structure adapted to grasp a portion of said support structure of said existing shelving.

13. A kick plate and support arrangement for attaching said kick plate having two ends to an existing shelving system having two conventional horizontal support structures extending transversely beneath a lowest shelf, said support arrangement comprising:

(a) two vertical clamp means for attaching to corresponding conventional horizontal support structures of said existing shelf system;

(b) two horizontal support means for rotatably supporting said kick plate at each end, each said horizontal support means being connected to a corresponding vertical clamp means and extending transversely to said horizontal support structure;

said kick plate having a front piece, back piece, and a shoulder piece connecting said front piece and said, back piece, a space under said shoulder piece being configured to accommodate said horizontal support means to said kickplate.

14. The kick plate and support arrangement of claim 13, wherein said support arrangement and kick plate are comprised of plastic material.

15. The kick plate and support arrangement of claim 13, wherein said support arrangement is comprised of plastic and said kick plate is comprised of metal.

16. The kick plate and support arrangement of claim 13, wherein said two horizontal support means are cylindrical.

17. The kick plate and support arrangement of claim 13, wherein said shoulder piece is rounded.

18. The kick plate and support arrangement of claim 17, wherein said rounded shoulder piece has a curvature conforming to a curvature of said horizontal support means.

19. The kick plate and support arrangement of claim 18, wherein said back piece is configured to extend from said shoulder piece and to a back surface of said front piece.

20. The kick plate and support arrangement of claim 19, wherein said back piece, said shoulder piece and said front piece form a closed structure.

21. The kick plate and support arrangement of claim 20, wherein said vertical clamp means comprises two vertical arms arranged to fit on either side of a flange of said conventional horizontal support structure.

22. The kick plate and support arrangement of claim 21, wherein said vertical arms are configured to conform to contours of said flange.

23. The kick plate and support arrangement of claim 22, wherein said one of said vertical arms is cylindrical.

24. The kick plate and support arrangement of claim 23, wherein a second of said vertical arms is configured to have spring-like characteristics.

* * * * *